US005607314A

United States Patent [19]

Chuang

[11] Patent Number: 5,607,314

[45] Date of Patent: Mar. 4, 1997

[54] ELECTRIC ADAPTER

[76] Inventor: Johnson Chuang, 2F, No. 85, Lane 59, Chung-Chen Rd, Lou-chow Hsiang, Taipei Hsien, Taiwan

[21] Appl. No.: 491,598

[22] Filed: Jun. 16, 1995

[51] Int. Cl.[6] ..... H01R 9/09

[52] U.S. Cl. ..... 439/83; 439/70; 439/58

[58] Field of Search ..... 439/638, 651, 439/654, 83, 650, 655, 78, 76.1, 62, 554, 58, 567, 68, 752, 70, 71

[56] References Cited

U.S. PATENT DOCUMENTS 4,710,133 12/1987 Lindeman ..... 439/62
5,080,611 1/1992 Hypes ..... 439/554
5,161,985 11/1992 Ramsey ..... 439/76.1
5,263,867 11/1993 Doi et al. ..... 439/752
5,462,444 10/1995 Korsunsky et al. ..... 439/567

*Primary Examiner*—Neil Abrams
*Assistant Examiner*—Brian J. Biggi
*Attorney, Agent, or Firm*—Bacon & Thomas

[57] ABSTRACT

An electric adapter including a PC board, two electric connectors respectively mounted on the PC board at two opposite sides and insulated from it by a respective insulator, each metal contact having a bottom end, a lead portion radially and outwardly extended from the bottom end of the respective metal contact and closely attached to one insulator, a tip welded to the circuit of the PC board, and a bent portion connected between the lead portion and the tip and closely attached to the periphery of the corresponding insulator.

5 Claims, 6 Drawing Sheets

ELECTRIC ADAPTER

BACKGROUND OF THE INVENTION

The present invention relates to an electric adapter comprised of two electric connectors mounted on a PC board at two opposite sides.

When connecting a PC board or conductive member between electric devices, electric connectors shall be used. FIG. 1 shows two electric connectors 11 and 12 mounted on one side of a PC board 10 at two opposite ends to form with the PC board 10 an electric adapter. This structure of electric adapter needs much installation space. FIG. 2 shows another structure of electric adapter according to the prior art, in which the PC board 13 has one end inserted in between the two rows of metal contacts 16 of a first electric connector 14 and an opposite end inserted in between the two rows of metal contacts 17 of a second electric connector 15. This structure of electric adapter cannot use circular electric connectors or any electric connector having three or more rows of metal contacts. FIG. 3 shows an electric adapter according to U.S. Pat. No. 4,618,196, which is the commercially available smallest electric adapter nowadays. However, the application range of this structure of electric adapter is limited. For example, a hole C must be made between two adjacent metal contacts A and B at one side for mounting a metal contact D at an opposite side. Because two metal contacts A and D cannot be simultaneously installed in a contact mounting hole on the PC board 18, all metal contacts at two opposite sides must not be aligned. Furthermore, regular electric adapters are made as small as possible in current markets. For example, in an SCSI electric adapter, the distance between the longitudinal central axes of two adjacent metal contacts is about 1.27 mm, and the pitch between two adjacent metal contacts is as narrow as 0.6 mm. Therefore, it is difficult to make a hole between two adjacent metal contacts.

SUMMARY OF THE INVENTION

The present invention has been accomplished to provide an electric adapter which eliminates the aforesaid drawbacks. According to the present invention, the electric adapter comprises a PC board, two electric connectors respectively mounted on the PC board at two opposite sides and insulated from it by a respective insulator, each metal contact having a bottom end, a lead portion radially and outwardly extended from the bottom end of the respective metal contact and closely attached to one insulator, a tip welded to the circuit of the PC board, and a bent portion connected between the lead portion and the tip and closely attached to the periphery of the corresponding insulator.

DETAILED DESCRIPTION OF THE PREFERRED EMBODIMENT

Figure 1:
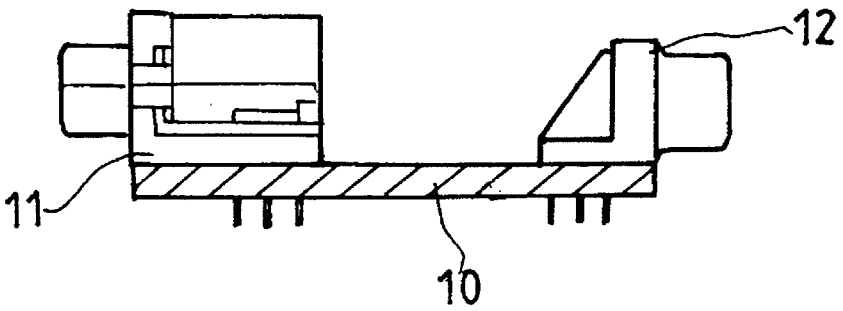
FIG.1 (PRIOR ART)
FIG. 1 shows an electric adapter according to the prior art.
Figure 2:
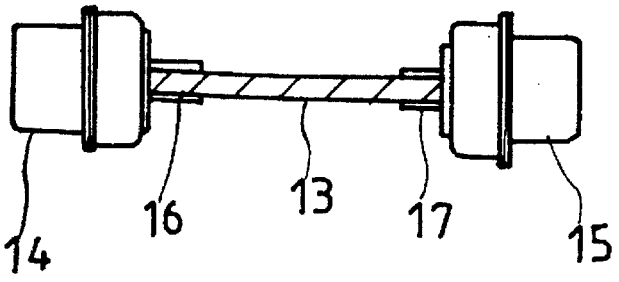
FIG.2 (PRIOR ART)
FIG. 2 shows another electric adapter according to the prior art.
Figure 3:
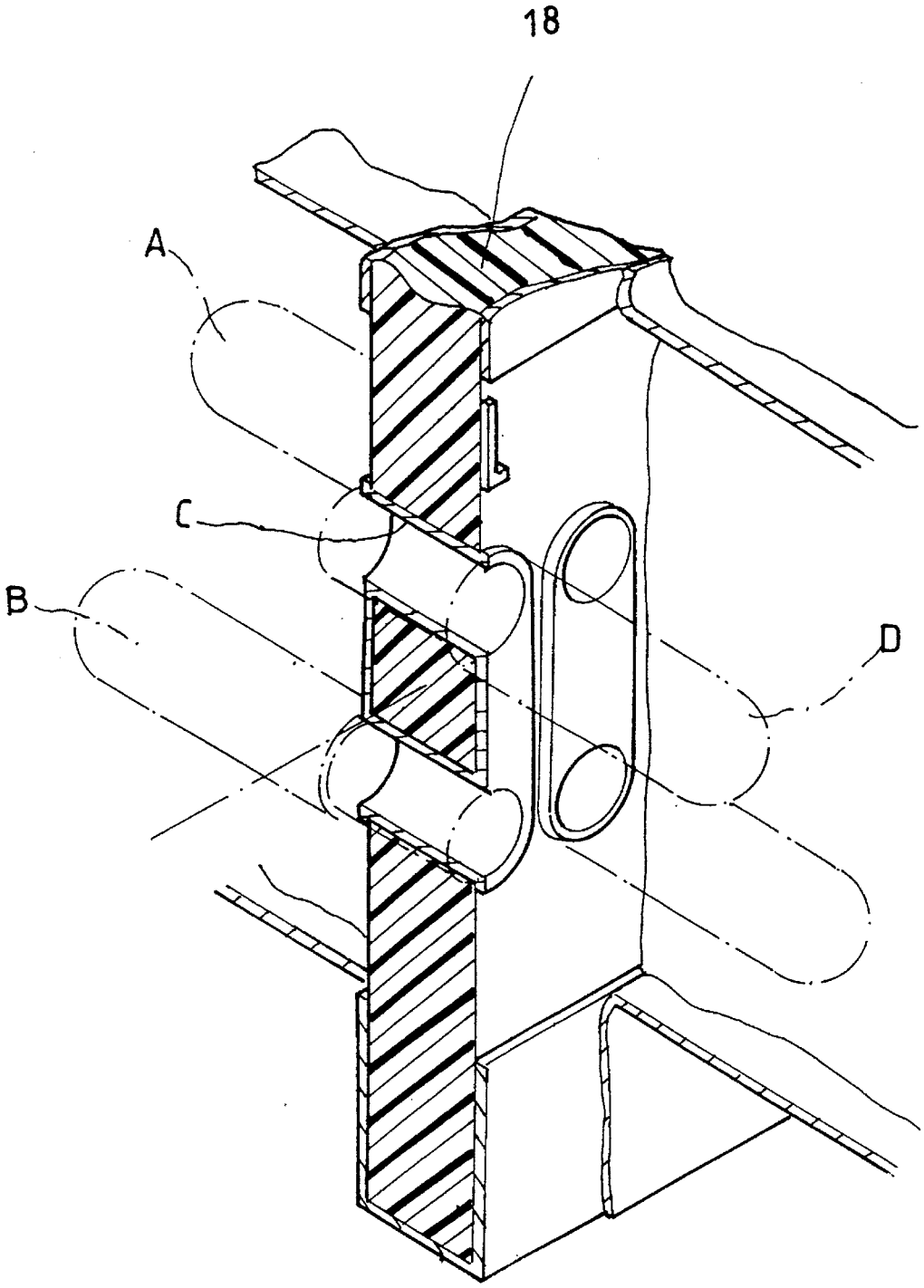
FIG.3 (PRIOR ART)
FIG. 3 shows an electric adapter according to U.S. Pat. No. 4,618,196.
Figure 4:
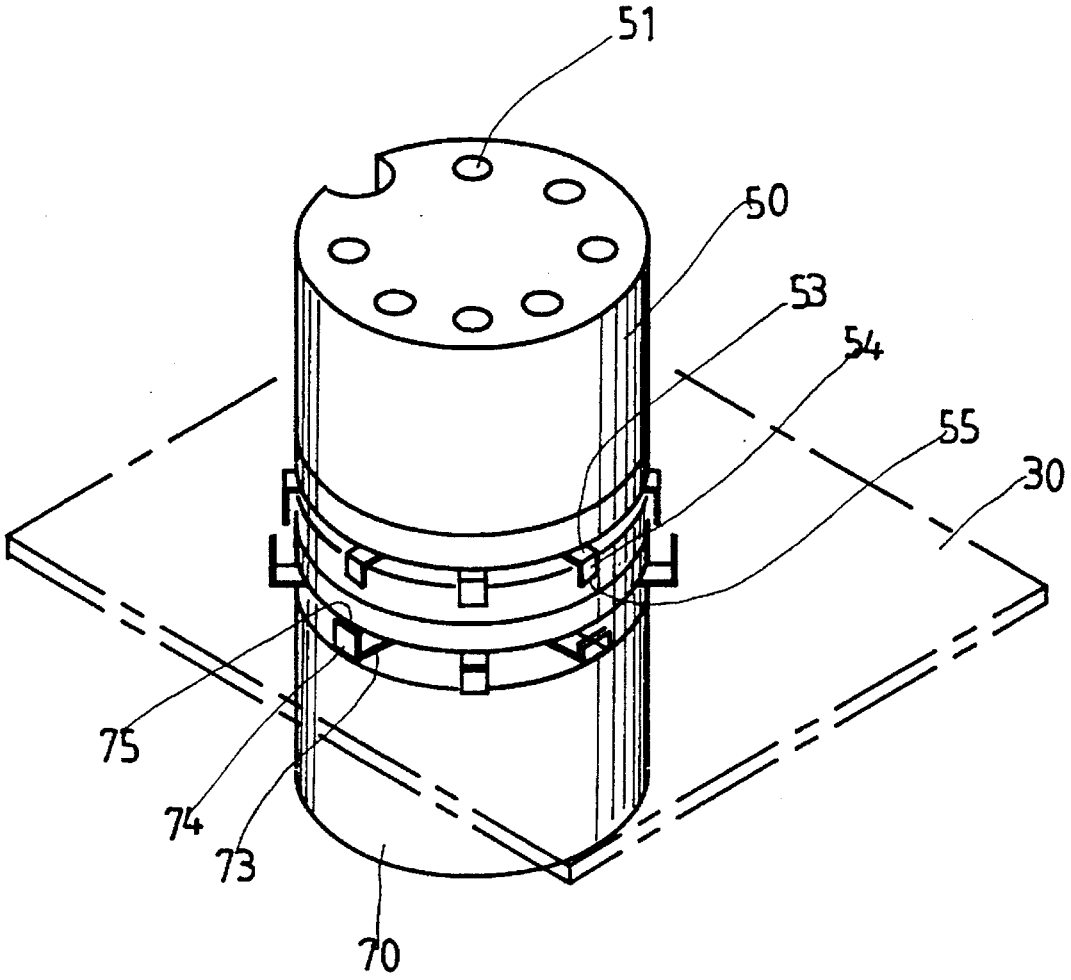
FIG. 4 is a perspective view of an electric adapter according to the present invention.
Figure 5:
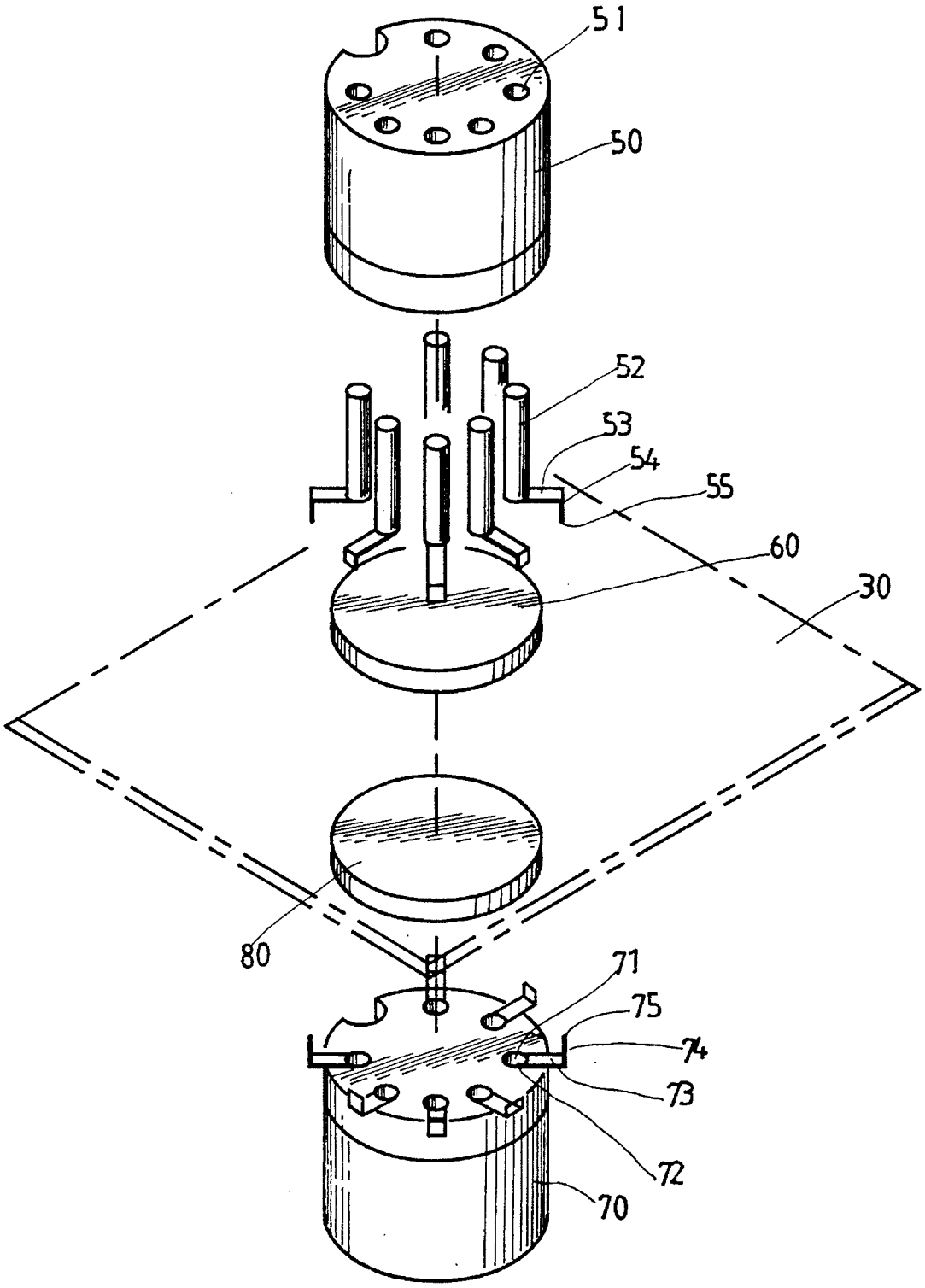
FIG. 5 is an exploded view of the electric adapter shown in FIG. 4.

Referring to FIGS. 4 and 5, a first electric connector 50 and a second electric connector 70 are aligned at two opposite sides of a PC board (conductive member) 30. The electric connectors 50 and 70 and the PC board 30 form a DIN SOCKET to DIN SOCKET adapter. The electric connector 50 or 70 has pin holes 51 or 71 and metal contacts 52 or 72 respectively fitted into the pin holes 51 or 71. An insulator 60 or 80 is mounted between the PC board (conductive member) 30 and the metal contacts 52 or 72 of the electric connector 50 or 70. The insulator 60 or 80 is made of suitable material (for example, plastics), in the form of a membrane.

Figure 6:
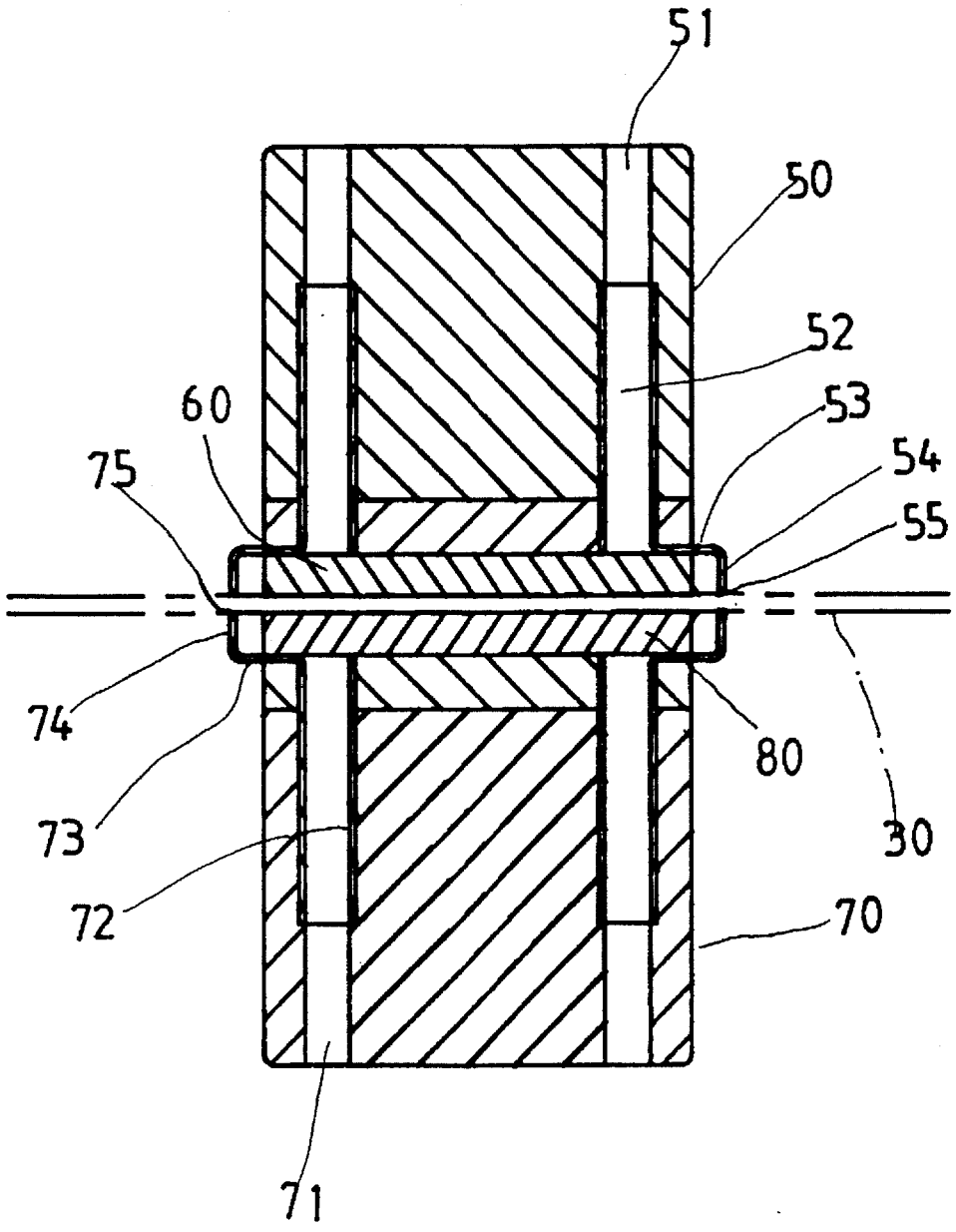
FIG. 6 is a sectional view of the electric adapter shown in FIG. 4.
Figure 7:
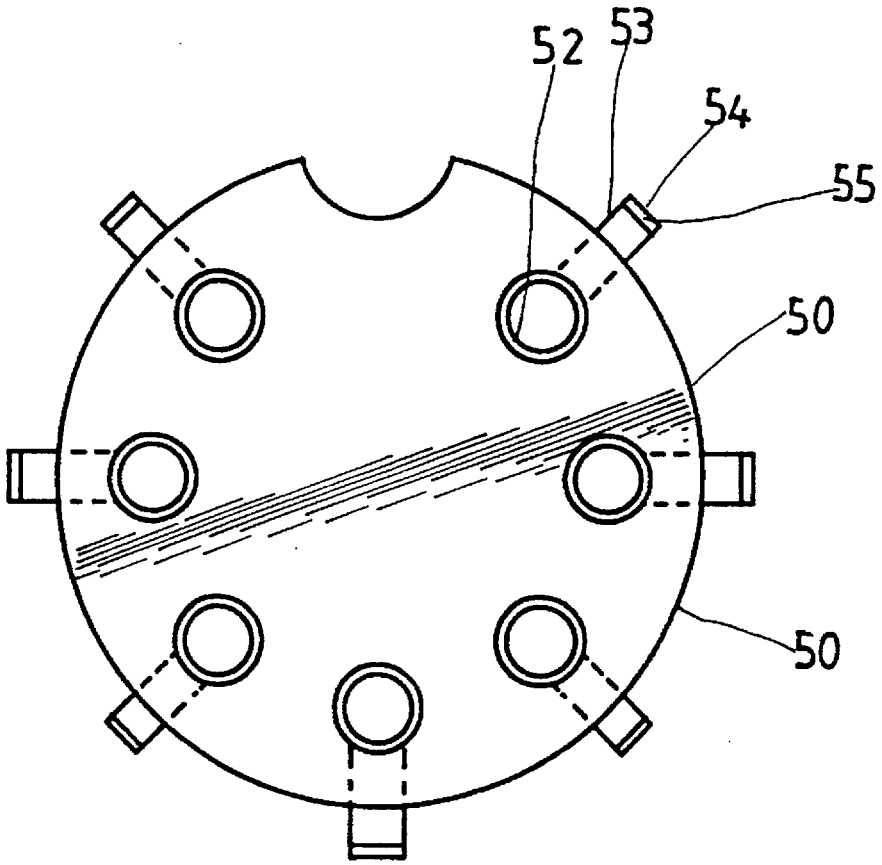
FIG. 7 is a top plain view of the electric adapter shown in FIG. 4.

Referring to FIGS. 6 and 7 and FIG. 5 again, each metal contact 52 or 72 has a lead portion 53 or 73 at the bottom end closely attached to the top side of the respective insulator 60 or 80, and a tip 55 or 75 closely attached to the PC board (conductive member) 30 for welding, and a bent portion 54 or 74 connected between the lead portion 53 or 73 and the tip 55 or 75 and closely attached to the periphery of the insulator 60 or 80. Alternatively, the lead portion 53 or 73 of each metal contact 52 or 72 may be embedded in the respective insulator 60 or 80 without touching the circuit of the PC board (conductive member) 30. The lead portion 53 or 73, the bent portion 54 or 74, and the tip 55 or 75 are made in integrity. Alternatively, the lead portion 53 or 73, the bent portion 54 or 74, and the tip 55 or 75 can be separately made and then connected together. Because the electric connectors 50 and 70 are aligned at two opposite sides of the PC board (conductive member) 30, the dimension of the PC board (conductive member) 30 can be minimized, and it is not necessary to make holes on the PC board (conductive member) 30 for mounting the electric connectors 50 and 70. Because the welding points (the tips 55 and 75) of the metal contacts 52 and 72 are radially extended out of the periphery of the electric connectors 50 and 70, less limitation is given to the circuit design of the PC board (conductive member) 30.

I claim:

1. An electric adapter comprising; a substantially planar conductive member having electrical contacts on opposite sides; a substantially cylindrical electric connector mounted on each of said opposite sides of said conductive member, each electric connector having a plurality of pin holes located in a substantially circular array, insulators mounted between said conductive member and each of said electric connectors; and a plurality of metal contacts mounted in the pin holes of each electric connector, each metal contact having a bottom end, a lead portion extending radially and outwardly of the electric connector from the bottom end and closely attached to one insulator, a tip connected to an electrical contact on said conductive member, and a bent portion connecting said lead portion and said tip and closely attached to a periphery of one of the insulators.

2. The electric adapter of claim 1 wherein said conductive member comprises a printed circuit board.

3. The electric adapter of claim 1 wherein said insulators each comprise a membrane.

4. The electric adapter of claim 1 wherein the lead portions of said metal contacts are embedded in said insulator.

5. The electric adapter of claim 1 wherein the electric connector comprises a DIN socket.

* * * * *